US008653980B2

(12) United States Patent
Brigham et al.

(10) Patent No.: US 8,653,980 B2
(45) Date of Patent: Feb. 18, 2014

(54) ALARM FOR DETECTING RADIATION AND/OR AIR POLLUTANTS

(75) Inventors: Peter Brigham, Coventry (GB); Stuart Hart, Coventry (GB)

(73) Assignee: Sprue Safety Products Ltd, London (GB)

( * ) Notice: Subject to any disclaimer, the term of this patent is extended or adjusted under 35 U.S.C. 154(b) by 236 days.

(21) Appl. No.: 13/146,340

(22) PCT Filed: Jan. 28, 2010

(86) PCT No.: PCT/GB2010/000131

§ 371 (c)(1),
(2), (4) Date: Oct. 13, 2011

(87) PCT Pub. No.: WO2010/086601

PCT Pub. Date: Aug. 5, 2010

(65) Prior Publication Data

US 2012/0044075 A1 Feb. 23, 2012

(30) Foreign Application Priority Data

Jan. 28, 2009 (GB) ..... 0901343.4

(51) Int. Cl.
*G08B 17/10* (2006.01)

(52) U.S. Cl.
USPC ..... 340/628; 340/540; 340/632; 340/635

(58) Field of Classification Search
USPC ..... 340/600, 628, 632
See application file for complete search history.

(56) References Cited

U.S. PATENT DOCUMENTS

| | | | | |
|---|---|---|---|---|
| 5,138,562 | A | 8/1992 | Shaw et al. | |
| 5,598,147 | A * | 1/1997 | Mochizuki et al. | 340/630 |
| 2004/0021576 | A1 | 2/2004 | Scott et al. | |
| 2004/0135684 | A1 | 7/2004 | Steinthal et al. | |
| 2007/0164872 | A1 | 7/2007 | Monroe | |
| 2007/0205891 | A1 | 9/2007 | Spencer et al. | |
| 2009/0109042 | A1 * | 4/2009 | Almiman | 340/628 |

FOREIGN PATENT DOCUMENTS

| | | |
|---|---|---|
| EP | 0396966 | 11/1990 |
| JP | 2000099856 | 10/2001 |
| JP | 2000099856 | 4/2007 |
| WO | WO 2006-088842 | 8/2006 |

OTHER PUBLICATIONS

Search Report issued in UK Pat. Appl. No. GB0901343.4 on May 28, 2009.
Int'l Preliminary Report on Patentability (IPRP) issued in application No. PCT/GB2010/000131 (2010.).

* cited by examiner

*Primary Examiner* — Kerri McNally
(74) *Attorney, Agent, or Firm* — Barnes & Thomburg LLP

(57) ABSTRACT

An alarm for detecting radiation and/or air pollutants such as smoke, carbon monoxide or the like has a control circuit (11) including a microcontroller (12) configured to monitor preselected alarm parameters, and memory means (30, 36, 40) for storing data representing said parameters. The microcontroller (12) has an input/output means (3) connectible both to a preselected voltage level for switching said control circuit between an operational mode and a shutdown mode and to an external processing means for enabling downloading and display of said data.

25 Claims, 6 Drawing Sheets

15

Microcontroller
13
28
29
10
3
12
18
Buzzer Drive Circuit
11
14
27
Digital I/O
Temperature Sensor
User Controls
26
Analog Inputs
LEDs
Voltage Reference
20
16
22
24
Electrochemical Sensor
Sensing Amplifier & Diagnostic Circuits

ALARM FOR DETECTING RADIATION AND/OR AIR POLLUTANTS

CROSS REFERENCE TO RELATED APPLICATIONS

This patent application is a U.S. nationalization under 35 U.S.C. §371 of International Application No. PCT/GB2010/000131, filed Jan. 28, 2010, which claims priority to United Kingdom Patent Application No. GB0901343.4, filed Jan. 28, 2009. The disclosures set forth in the referenced applications are incorporated herein by reference in their entireties.

The present invention relates to alarms, particularly carbon monoxide (CO) and smoke detectors.

BACKGROUND OF THE INVENTION

The majority of CO alarms tend to fall into one of two groups. The first group of alarms are basic alarms that, when activated, provide a visual alarm warning display via a number of light emitting diodes (LEDs) and an audible warning via a horn. The second group of alarms are more expensive devices which have an LCD display which allows specific messages to be displayed.

A disadvantage with the cheaper LED only alarms is that, in the event of a product malfunction, being able to identify quickly the nature of the issue is difficult. A display of specific error codes can only be achieved by a combination of lit or flashing LEDs, which can be difficult to interpret. The more expensive LCD alarms can display specific error codes on the LCD. However, even here, only a very small amount of information can be displayed at the same time.

BRIEF SUMMARY OF THE INVENTION

The present invention seeks to provide an improved alarm.

Accordingly, the present invention provides an alarm for detecting radiation and/or air pollutants such as smoke, carbon monoxide or the like, the alarm having: a control circuit including a microcontroller configured to monitor preselected alarm parameters; and memory means for storing data representing said parameters; wherein said microcontroller has an input/output means connectible to a preselected voltage level for switching said control circuit between an operational mode and a shutdown mode and connectible to an external processing means for enabling downloading and display of said data.

In a preferred embodiment of the invention said preselected voltage level is battery negative, neutral or 0 volts and said input/output means is connectible to said preselected voltage via a detachable link.

Preferably, said preselected data contains information on alarm activation and faults and on parameters monitored in real time including battery voltage level.

The present invention also provides a method of operating an alarm for detecting radiation and/or air pollutants such as smoke, carbon monoxide or the like, the alarm having a control circuit including a microcontroller configured to monitor preselected alarm parameters and the microcontroller having an input/output means connectible to a preselected voltage level for switching said control circuit between an operational mode and a shutdown mode and connectible to an external processing means for enabling downloading and display of said data, the method comprising the steps of: (a) checking the presence or absence of said preselected voltage level; and (b) in response to said check indicating that the alarm is in operating mode, transmitting said data to said input/output means for downloading to said external processing means.

In a preferred embodiment of the invention, prior to transmitting said data the microcontroller runs through at least one operational loop to record current data.

Advantageously, said alarm comprises user actuable switch means for initiating transmission of said data, and said method further comprises checking the status of said switch means when said alarm is in operating mode and transmitting said data to said input/output means in response to said check indicating user actuation of said switch.

BRIEF DESCRIPTION OF THE SEVERAL VIEWS OF THE DRAWING(S)

The present invention is further described hereinafter, by way of example, with reference to the accompanying drawings, in which.

DETAILED DESCRIPTION OF THE INVENTION

Figure 1:
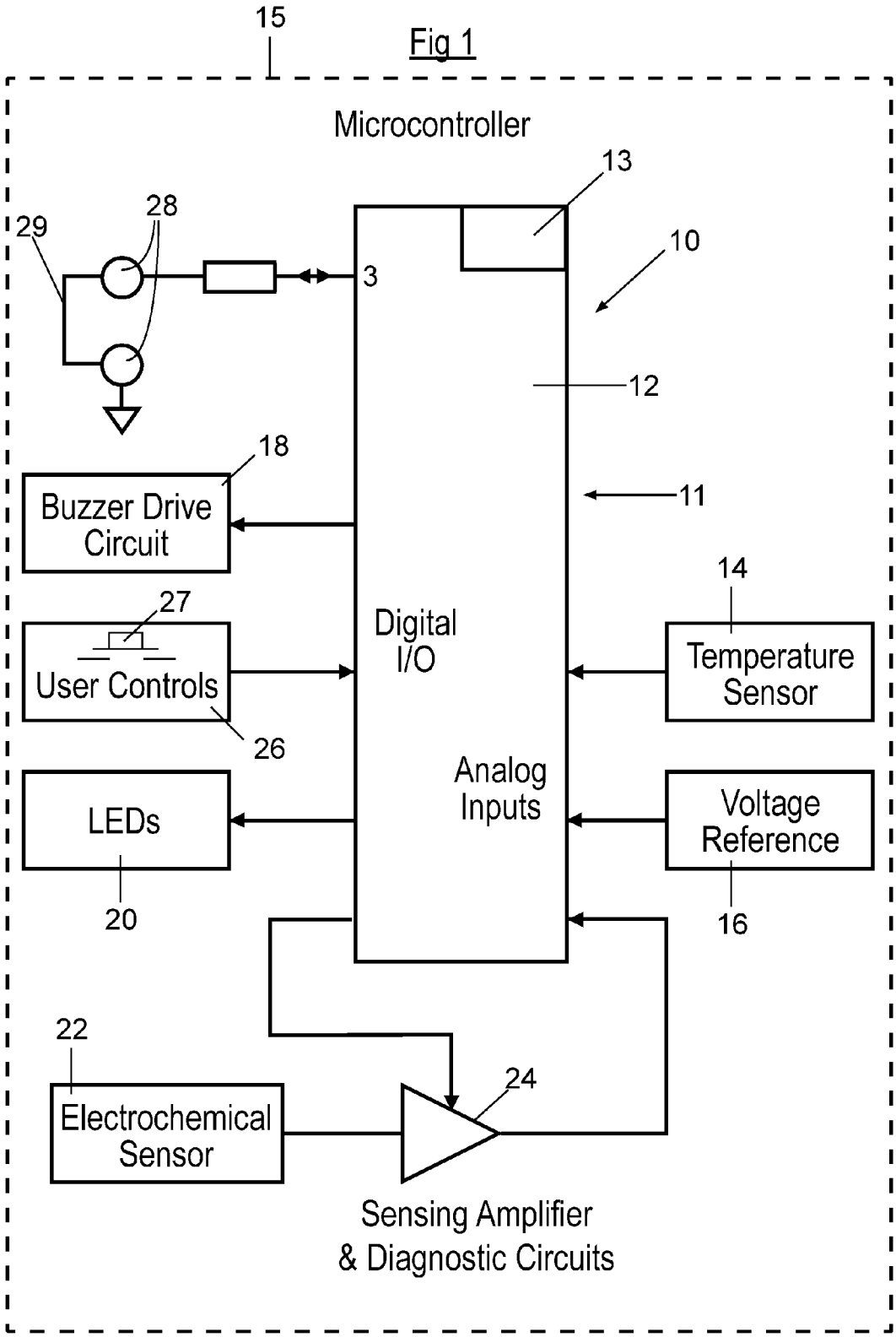
FIG. 1 is a block diagram of the circuit of an alarm.

Referring firstly to FIG. 1, this shows a block diagram of the control circuit 11 of an alarm 10. This is typically a carbon monoxide alarm although it will be appreciated that the invention is applicable to all types of alarm including smoke alarms and heat alarms.

The alarm has a housing containing the control circuit diagrammatically shown at 15.

The alarm is typically a LED only alarm.

The control circuit 11 of the alarm 10 has a microcontroller 12 to which a temperature sensor 14 and a voltage reference circuit 16 are connected. The temperature sensor 14 provides an indication of ambient temperature. A watchdog timer 13 is also provided.

The control circuit 11 further has a drive circuit 18 for driving an audible alarm such as a piezo-electric buzzer, and a bank of LEDs 20 which can be used to display normal functions of the alarm as well as error messages indicated by a combination of flashing and/or stable lit/unlit LEDs.

A suitable sensor such as an electro chemical sensor 22 is connected to the microcontroller 12 by way of a sensing amplifier and diagnostic circuit 24 to monitor levels of noxious substances, such as carbon monoxide, in the air.

A set of user controls 26 is provided to allow setting, testing and re-setting of the alarm. These include a test/reset button 27. If the alarm is activated, pressing the button 27 silences the alarm. If the alarm is not activated, pressing the button 27 tests the alarm.

Since many products of this type contain a sealed for life cell or battery pack for powering the alarm, the alarm has a disabling feature which forces the control circuit into a shutdown mode for transportation and storage. To this end, an input/output terminal, pin 3, of the microcontroller is connected to earth through a pair of terminals 28 which are normally open i.e. unconnected when the alarm is operating but are shorted by a shorting link 29 during transportation and storage. Connecting the relevant terminal 3 of the microcontroller to earth via the shorting link forces the alarm control circuit 11 into a shutdown mode. The terminals 28 are conveniently in the form of a socket and the shorting link is inserted into the socket to connect the contacts 28 during manufacture and assembly.

The microcontroller 12 is programmed to monitor and store a variety of information in the form of system constant data and system variable data when it runs through an operational software loop. The system constant data can include, for example, details of the software programmed into the microcontroller. The system variable data are values that typically change with time, such as calibration values determined during factory calibration of the alarm during manufacture. Although these values would normally not be changed during use, it is possible for the calibration values to be altered, during recalibration, for example, and these are therefore generally referred to as system variable data.

Figure 2:
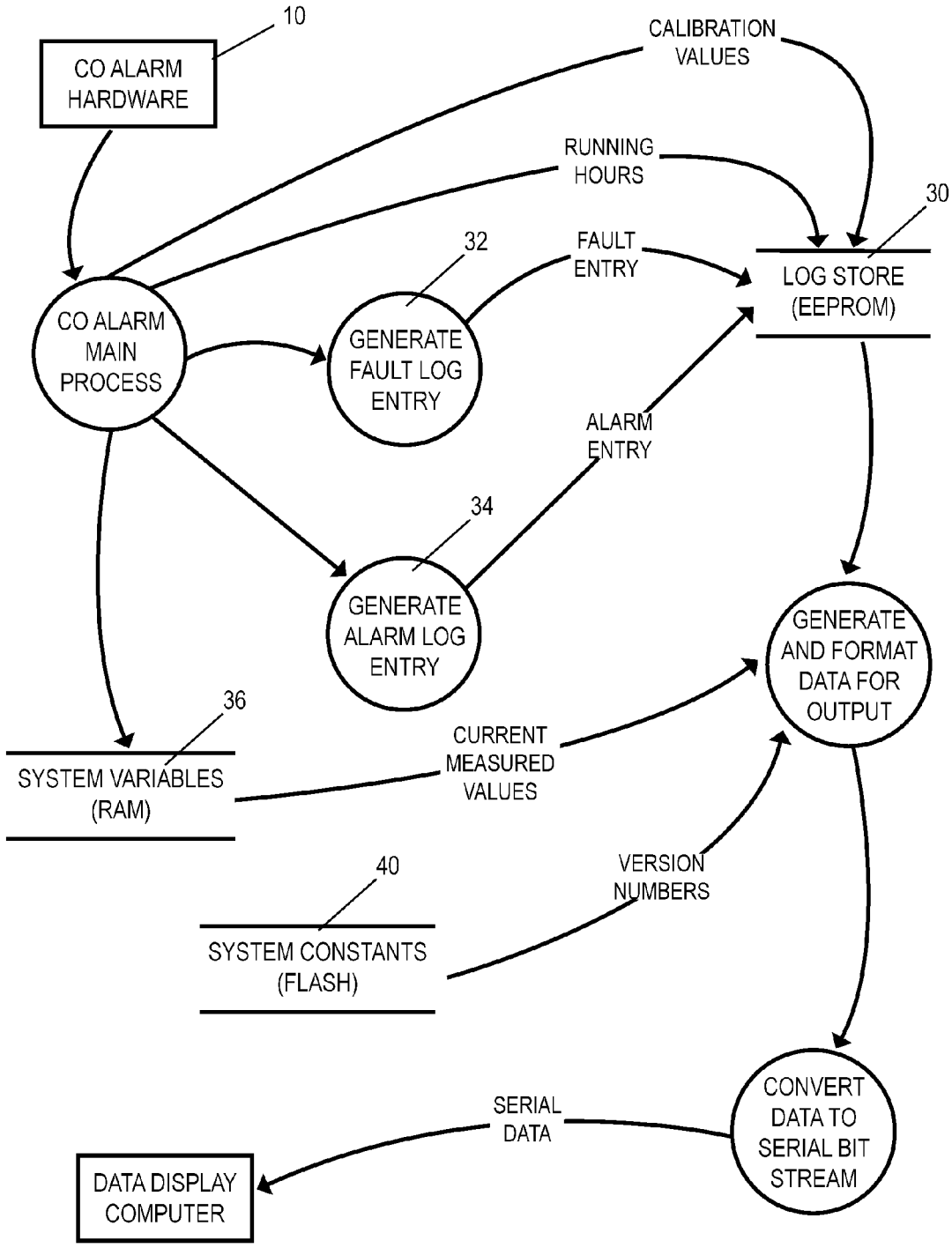
FIG. 2 is a data-flow diagram for the alarm circuitry, for generating and outputting data.

FIG. 2 is a data flow chart illustrating operation of the microcontroller 12.

The system constant and system variable data can be stored in a variety of ways. In the illustrated embodiment the microcontroller 12 stores some of the system data in a suitable log store 30 such as an EEPROM including calibration values as well as data on faults generated or activation of the alarm including dates, times and durations, by way of fault and alarm log entries 32, 34. The system constants can typically be stored in a Flash memory 40. It will be appreciated that both the EEPROM and Flash memory can store one or more of either of the system constant or variable data In addition, other system data are stored in a suitable memory 36 in the form of a Random Access Memory (RAM). These are values that typically change with time, such as the raw CO reading, the calculated CO level (ppm), the current temperature, battery voltage and the like and can include the number of hours during which the alarm has been operating, battery voltage levels over time, temperature levels over time and carbon monoxide readings over time including peak readings and other data. Additionally or alternatively any combination of some or all data such as the number of hours can be stored in the EEPROM 30 for data security in case of battery faults. Ideally, the number of hours the unit has been operating is stored both in EEPROM 30 and in the RAM 36 of the microcontroller 12. The EEPROM 30 in this case is acting as a back up to the RAM 36 in case of power loss. If the number of hours is ever required for calculations by the microcontroller it is taken from the RAM 36. The EEPROM 30 has a longer access time and slows down the operation of the microcontroller 12. The calibration information (which is also in both RAM and EEPROM) is a good example of this, the information being required every minute during the calculation of the detected CO levels.

An example of data that, conveniently, might only be stored in the EEPROM 30 is the alarm log and fault log data which is only needed by a services user during download of the historical data.

The information from the EEPROM, RAM and Flash memory are formatted by the microcontroller 12 and converted to a serial bit stream for output from the microcontroller pin 3 and through the terminals 28.

Figure 3:
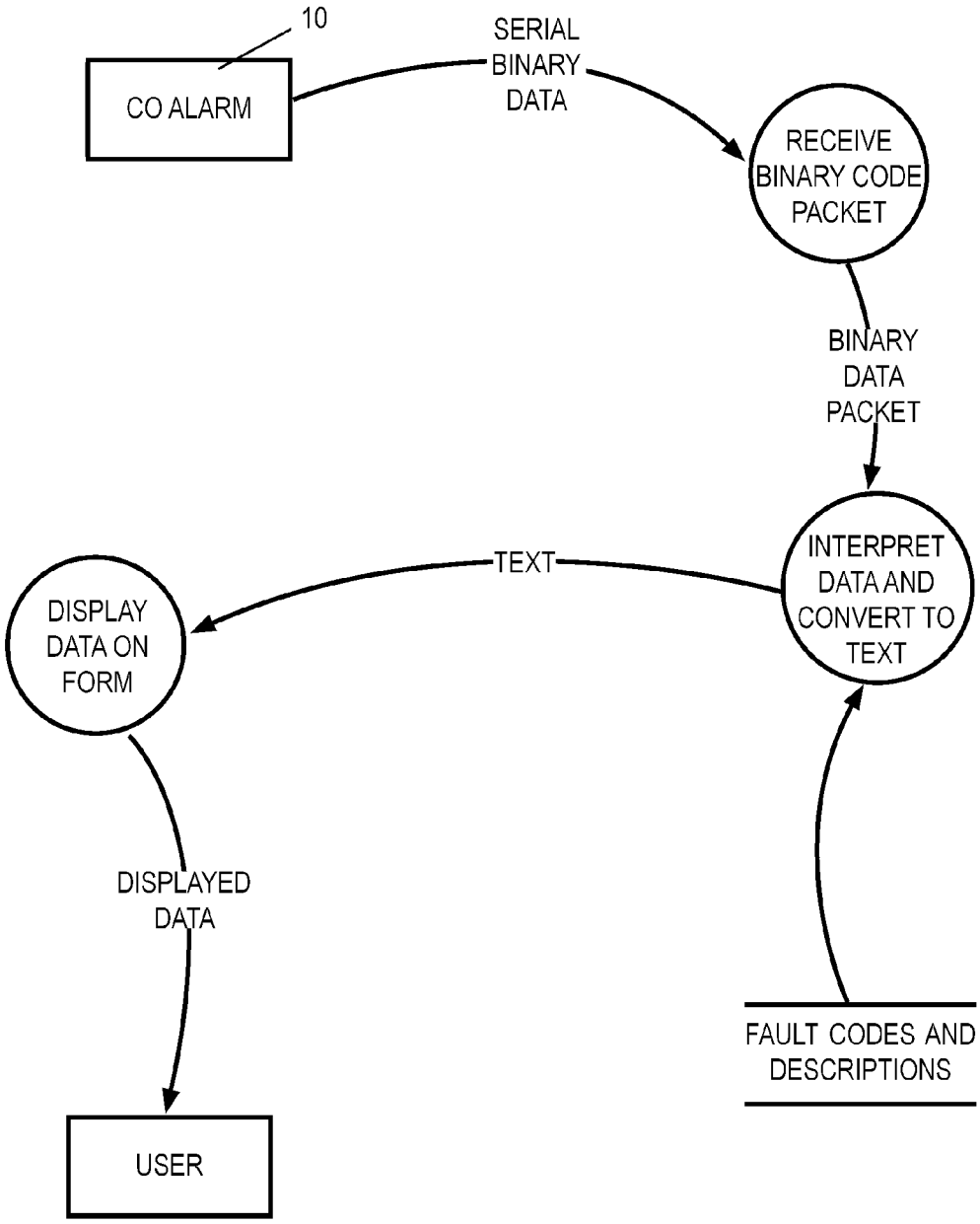
FIG. 3 is a data-flow diagram for a log receiver for receiving data from the alarm.

When an alarm is returned by a purchaser as faulty, a member of the customer service staff can plug a specialized data cable into the shorting link terminals 28 to download logged and current data from the microcontroller 12 in the alarm. The data can be downloaded to a computer or hand held processing device for display and FIG. 3 shows the data flow diagram for the computer. The test/hush button 27 is also pressed by the customer service staff to activate the data send.

The computer is programmed to download the data through the terminals 28 and convert it to text data for display on a suitable display such as the computer monitor or an LCD screen. The computer is programmed with the possible fault codes and descriptions and in dependence on the fault codes downloaded from the microcontroller 12 generates a corresponding description for display on the user display screen.

The alarm has four primary "operating" modes as described below:

1. Unpowered Mode

In this mode the battery is disconnected and the alarm is inactive.

2. Shutdown Mode

In this mode the battery is connected but the shipping disable link 29 is in place. The microcontroller is primarily in a sleep state but is woken by the watchdog timer 13 at a preselected shutdown time interval, typically every 2.2 seconds, and checks to see if the link is present. If the link is in place then the input/output pin 3 of the microcontroller 12 is pulled down to battery negative, neutral or 0 volts. During sleep mode the microcontroller does not run through any operational loops. This ensures that the microcontroller 12 is ON for a minimal period, reducing power drain to a minimum.

3. Operating But Not Detecting

In this mode the shipping disable link is removed. The unit will run through the main operation loop described below in relation to FIG. 4. The microcontroller 12 is programmed to go into sleep mode after each loop and is woken by the watchdog timer 13 at a preselected operating time interval, typically every 1.1 seconds. After waking from sleep mode the microcontroller 12 again checks for the presence or absence of the disable link 29 and, if absent, repeats the operation loop.

4. Operating and Detecting

The microcontroller 12 is programmed to execute a CO sample after a predetermined time period, typically about every 60 seconds.

Figure 4:
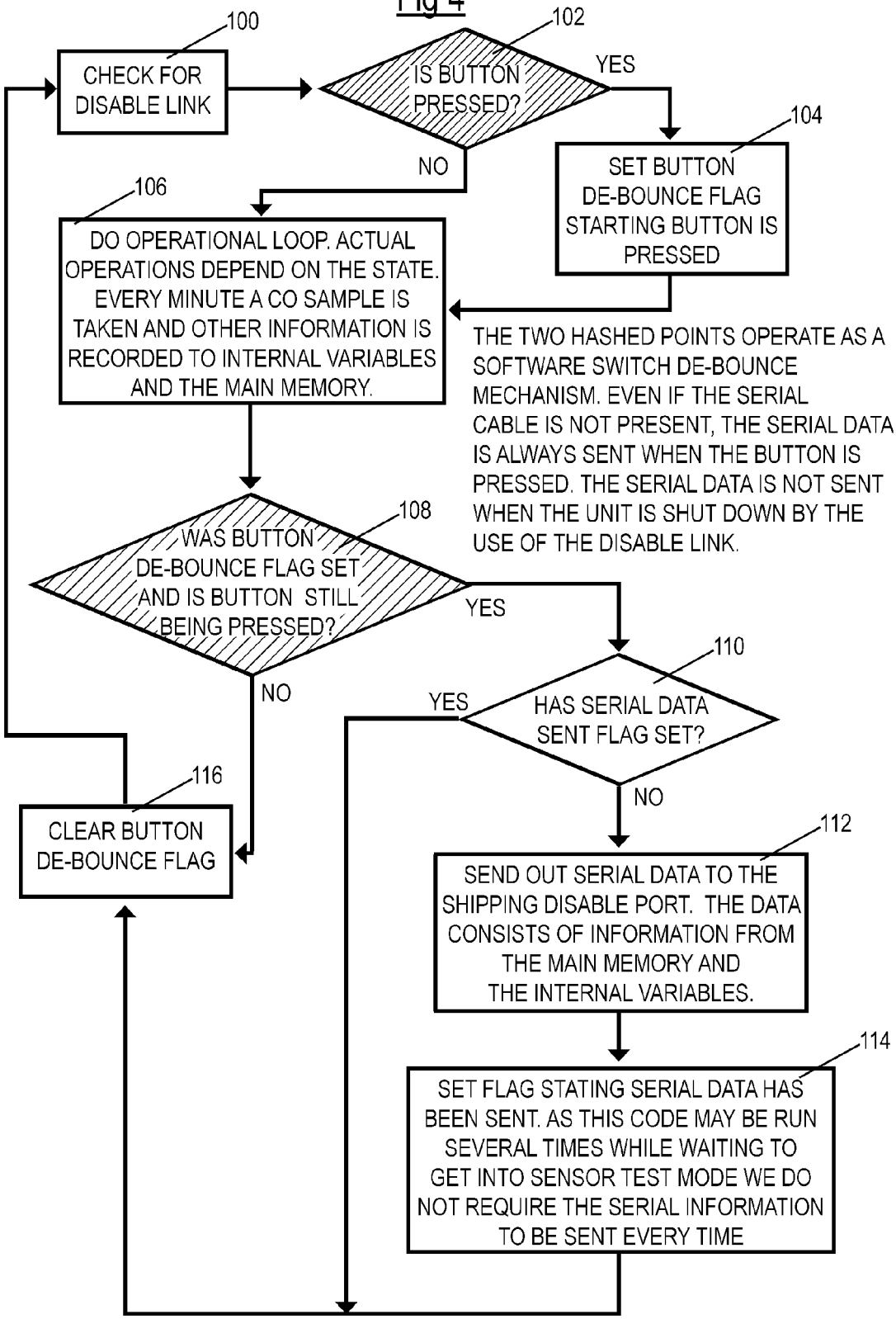
FIG. 4 is a flow chart of operation of the microcontroller in transmitting data.

Referring to FIG. 4, this shows a flow chart of operation of the microcontroller in executing data recordal and transmitting the serial data for output to the computer. The microcontroller repeatedly runs through the operational loop as described below.

If the microcontroller 12 is in sleep mode, it is woken by the watchdog timer 13 as described and the microcontroller then checks at 100 to see if the disable link, which shorts the contacts 28, is in place. If it is in place then the microcontroller goes back into sleep mode before waking again to repeat the check. This continues until the disable link 27 is removed, at which point the microcontroller 12 then checks to see if the test/hush button is been pressed at 102. If the button is pressed then the microcontroller sets a "button de-bounce" flag 104 indicating that the button has been pressed. Regardless of whether or not the button has been pressed, the microcontroller 12 then runs through an operational loop 106 to sample system data. For example, the system may sample the CO content of the air and store the value in RAM 36.

The microcontroller 12 then checks at 108 to see (a) if the "button de-bounce" flag is set and (b) if the button is still being pressed. If the button is still being pressed, the microcontroller 12 checks the "serial data sent" flag 110. If this indicates that serial data has not been sent to the terminals 28 then the system sends the serial data (112) to the terminals and sets the "serial data sent" flag at 114. If the "serial data sent" flag 110 was set, no data is sent and the system again checks to see if the disable link is in place at 100 and repeats the loop. When the button is released the "serial data sent" flag 110 is cleared.

The two checks on the status of the button serve as a software switch de-bounce mechanism to ensure a proper determination of the switch status.

If the second check of the button state indicates that it is no longer being pressed then the "button pressed" flag is cleared at 116 and the loop begins again with a check to see if the disable link is in place at 100.

It would of course be possible for the data to be continuously sent to the output 28 regardless of whether or not the button 27 had been pressed but this would result in a significant increase in power consumption for the control circuit because of the additional time that the microcontroller 12 is awake. Transmission only when the button 27 has been pressed keeps the power consumption to a minimum.

Figure 5A:
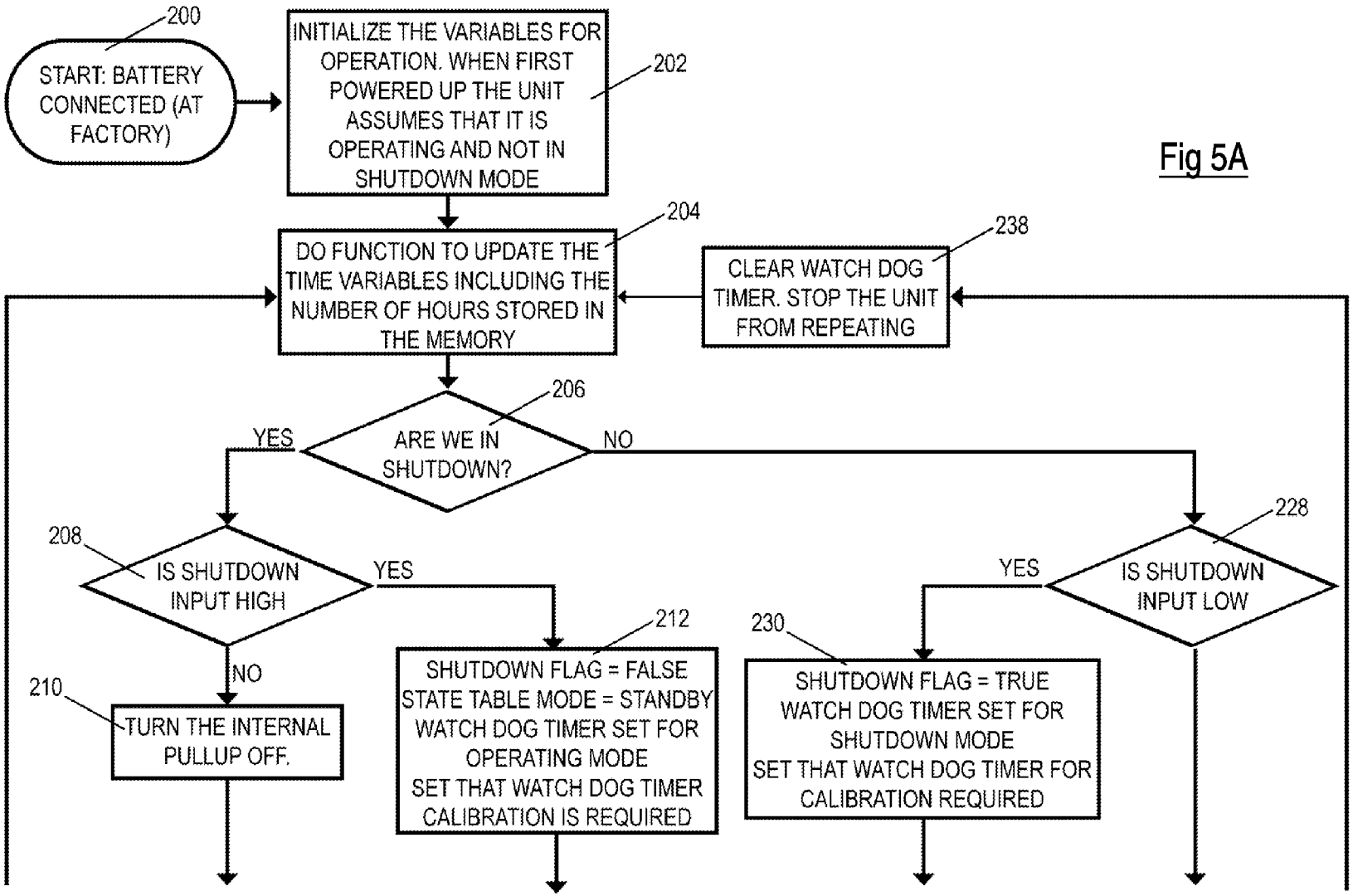
FIGS. 5A and 5B are a flow chart of operation of the microcontroller in operating and shutdown modes.
Figure 5B:
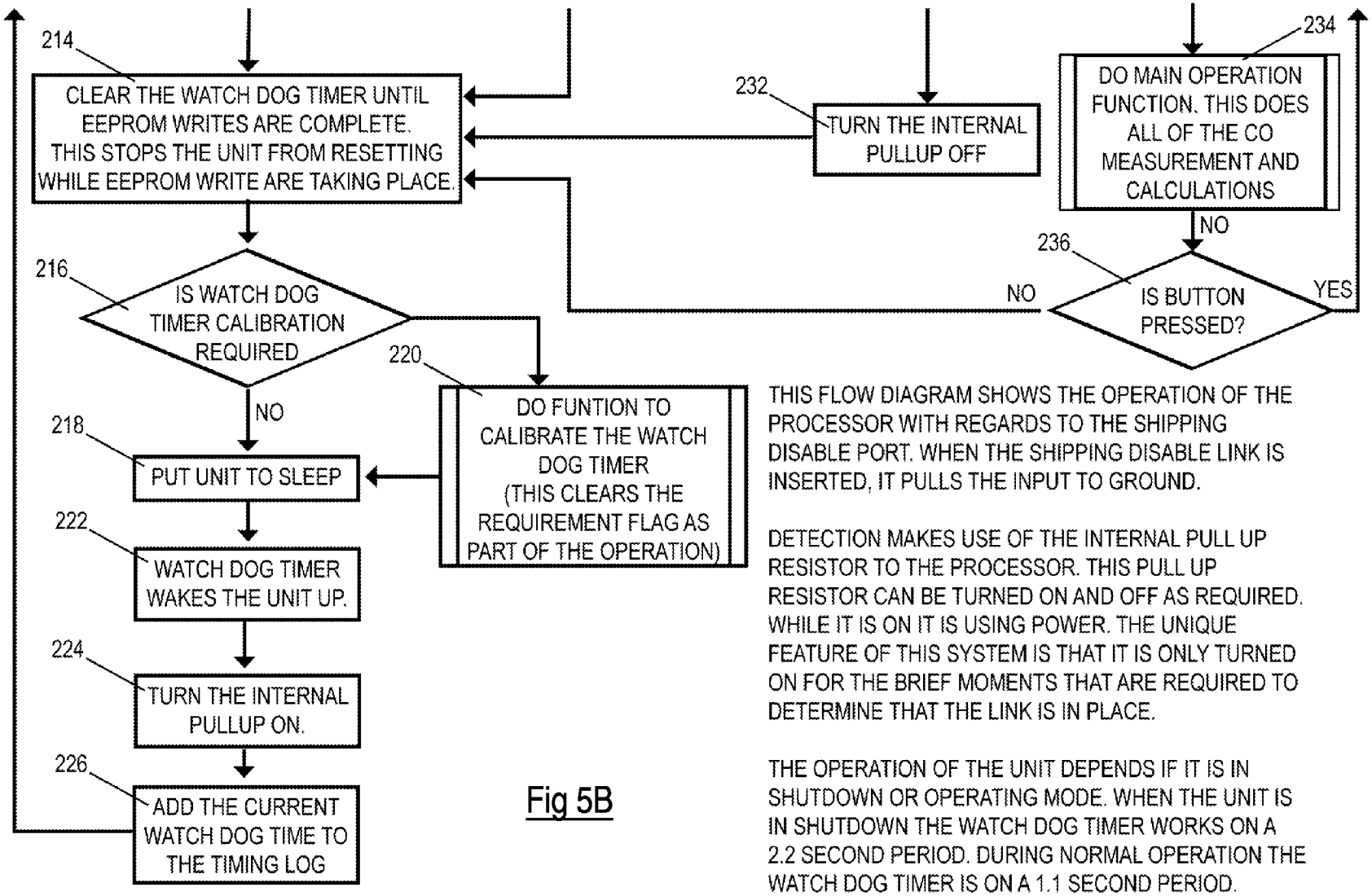

Turning to FIGS. 5A and 5B, this shows the operational steps of the microcontroller.

Initially, assuming the alarm is in unpowered mode, on first power up at 200 the system assumes an operational state and initialises and sets the system default variables at 202. The system then updates the time variables at 204, which can include, for example, the time since first calibration. When the system is first powered up there will be no variables to update and the system will go straight to the shutdown check at 206.

After updating the time variables at 204 the microcontroller checks to see if the system is in operational or shutdown mode at 206. If the system is in shutdown mode the microcontroller 12 checks to see if the shutdown input (pin 3) to the microcontroller is high at 208. If it is low this indicates that the disable link 29 is in place and the microcontroller 12 then turns its internal pullup OFF at 210. This stops current drain through the disable link to earth.

If the shutdown input (pin 3) is high this indicates that the disable link has been removed and the "shutdown" flag is set to "False" at 212. The microcontroller 12 also has timer means in the form of a watchdog timer 13 which serves two purposes.

The watchdog timer 13 counts from zero to a predefined number and has two operating modes, a first when the alarm 10 is in shutdown mode and a second when it is in operating mode.

When the alarm is shutdown mode and the microcontroller 12 is in sleep mode the watchdog timer 13 wakes the microcontroller after a predetermined count, typically 2.2 seconds. In this case when the timer reaches a predefined number the microcontroller is forced to wake up to check for the presence or absence of the link 29.

When the microcontroller 12 is in operating mode the watchdog timer 13 takes a role in checking the status of the microcontroller 12. Normally, as the microcontroller 12 runs through its operating steps it resets the watchdog timer 13 to begin its count again before the timer reaches a further predetermined count, typically 1.1 seconds. However, if the timer is not reset and reaches this predetermined count, it indicates that the microcontroller 12 has "locked" and the timer then causes the microcontroller 12 to be hard reset, i.e. it acts as if power has been removed and restored. In essence the microcontroller 12 starts from scratch and reloads all of the stored data.

It is possible for the microcontroller 12 to clear the watchdog count as part of the operation loop in order to give more time for certain operations to complete. For example, to prevent the watchdog timer 13 from resetting the microcontroller 12 whilst data is being written to the EEPROM 30, the watchdog timer is cleared at 214 until any "writes" are complete. If the operation gets stuck and does not continue then the watch dog timer will reset the microcontroller.

The microcontroller then checks at 216 to see if calibration of the watchdog timer is required. If not, the alarm is put into sleep mode at 218 for a preselected time period, typically 1.1 or 2.2 seconds depending on the alarm mode as described above. If calibration is required then the watchdog timer is calibrated at 220 before the alarm is put into sleep mode.

The watchdog timer then wakes the microcontroller 12 up at 222 after a preselected count and the microcontroller internal pullup is turned ON at 224. The current watchdog time is added to the timing log at 226 and stored in EEPROM 30, following which the microcontroller again carries out an update of the time variables at 204 and repeats the loop.

If the response to the "shutdown" interrogation at 206 is "No", the microcontroller checks to see if the shutdown input on pin 3 is low at 228. If it is, this indicates that the disable link 29 is present and the "shutdown" flag is set to "True" at 230. The watchdog timer is also reset so that the watchdog timer will awaken the microcontroller 12 after the preselected sleep interval if the microcontroller remains in sleep mode for the preselected shutdown time period, indicating that the circuitry has "locked" in sleep mode.

The timing of the watchdog timer can also be checked against an internal clock and recalibrated if necessary.

The microcontroller then turns the microcontroller internal pullup OFF at 232. This stops current drain through the disable link to earth, and the microcontroller 12 then continues the operating steps from 214 as described above.

If the shutdown input on pin 3 is not low, this indicates that the disable link is absent and the microcontroller then runs through one or more operational functions at 234 such as taking CO and temperature measurements and running through necessary calculations. The microcontroller then checks the status of the "button pressed" flag at 236. If this indicates that the button has not been pressed the microcontroller then continues the operating steps from 214 as described above. If, however, the status of the "button pressed" flag indicates that the button has been pressed the microcontroller clears the watchdog timer at 238 to prevent the alarm from being forcibly reset as described above if the watchdog timer times out. If the button is pressed then the next cycle of operation is processed without the normal 1.1 second sleep period.

No additional hardware is required in the alarm to provide the above described powerful additional features provided there is at least one available spare pin on the microcontroller 12.

The invention allows the provision of full diagnostic information with potentially no additional cost increase over that of a conventional LED only alarm.

The invention claimed is:

1. An alarm device for detecting radiation and/or air pollutants, the alarm having:

a control circuit including a microcontroller configured to monitor preselected alarm parameters;

memory means for storing data representing said parameters; and a detachable disabling feature for placing the control circuit into a shutdown mode for transportation or storage;

wherein said microcontroller has an input/output means connectable by said disabling feature to a preselected voltage level for switching said control circuit between an operational mode and said shutdown mode, and wherein the input/output means is also connectable, with said disabling feature detached, to an external processing means for enabling downloading and display of said data.

2. An alarm as claimed in claim 1 wherein said input/output means is connectable to said preselected voltage level to switch said control circuit from said operational mode into said shutdown mode.

3. An alarm as claimed in claim 2 wherein said preselected voltage level is battery negative, neutral or 0 volts and said input/output means is connectable to earth via a detachable link.

4. An alarm as claimed in claim 2 wherein:

said preselected data contains at least one of information on alarm activation and faults and on at least one parameter monitored in real time.

5. An alarm as claimed in claim 4 wherein the parameter comprises at least one of ambient temperature, battery voltage level and sensor readings.

6. An alarm as claimed in claim 2 wherein said microcontroller has timer means and said microcontroller is configured to switch from a sleep mode to said operating mode in response to said timer means reaching a first preselected count and to reset said counting means.

7. An alarm as claimed in claim 2 wherein when said microcontroller is in an operating mode said timer means resets said microcontroller after said timer means reaches a second preselected count indicating that said microcontroller has locked.

8. An alarm as claimed in claim 1 wherein said preselected voltage level is battery negative, neutral or 0 volts and said input/output means is connectable to earth via a detachable link.

9. An alarm as claimed in claim 1 wherein:

said preselected data contains at least one of information on alarm activation and faults and on at least one parameter monitored in real time.

10. An alarm as claimed in claim 9 wherein the parameter comprises at least one of ambient temperature, battery voltage level and sensor readings.

11. An alarm as claimed in claim 1 wherein said microcontroller has timer means and said microcontroller is configured to switch from a sleep mode to said operating mode in response to said timer means reaching a first preselected count and to reset said counting means.

12. An alarm as claimed in claim 1 wherein when said microcontroller is in an operating mode said timer means resets said microcontroller after said timer means reaches a second preselected count indicating that said microcontroller has locked.

13. A method of operating an alarm device for detecting radiation and/or air pollutants, the alarm having a control circuit including a microcontroller configured to monitor preselected alarm parameters and a detachable disabling feature for placing said control circuit into a shutdown mode for transportation or storage, said microcontroller having an input/output means connectable by said disabling feature to a preselected voltage level for switching said control circuit between an operational mode and said shutdown mode and connectable, with said disabling feature detached, to an external processing means for enabling downloading and display of data representing said monitored alarm parameters, the method comprising the steps of:

(a) checking the presence or absence of said preselected voltage level; and (b) in response to said check indicating that the alarm is in an operating mode, transmitting said data to said input/output means for downloading to said external processing means.

14. A method as claimed in claim 13 wherein prior to transmitting said data the microcontroller runs through at least one operational loop to record current data.

15. A method as claimed in claim 13 wherein said preselected voltage level is battery negative, neutral or 0 volts.

16. A method as claimed in any of claim 13 wherein:

said preselected data contains information on at least one of alarm activation and faults and at least one parameter monitored in real time.

17. A method as claimed in claim 16 wherein the parameter comprises at least one of ambient temperature, battery voltage level and sensor readings.

18. A method as claimed in claim 13 wherein said microcontroller is configured to switch from a sleep mode to said operating mode after a first preselected count.

19. An alarm as claimed in claim 13 wherein when said microcontroller is in an operating mode said microcontroller is reset after a second preselected count indicating that said microcontroller has locked.

20. A method of operating an alarm device for detecting radiation and/or air pollutants, the alarm having a control circuit including a microcontroller configured to monitor preselected alarm parameters and a detachable disabling feature for placing said control circuit into a shutdown mode for transportation or storage, said microcontroller having an input/output means connectable by said disabling feature to a preselected voltage level for switching said control circuit between an operational mode and said shutdown mode and connectable, with said disabling feature detached, to an external processing means for enabling downloading and display of data representing said monitored alarm parameters, the method comprising the steps of:

(a) checking the presence or absence of said preselected voltage level; and (b) in response to said check indicating that the alarm is in an operating mode, transmitting said data to said input/output means for downloading to said external processing means;

wherein said alarm comprises user actuable switch means for initiating transmission of said data, and said method further comprises checking the status of said switch means when said alarm is in an operating mode and transmitting said data to said input/output means in response to said check indicating user actuation of said switch.

21. A method as claimed in claim 20 wherein said user actuable switch means is actuable to initiate a test of the alarm.

22. A method as claimed in claim 20 wherein said preselected voltage level is battery negative, neutral or 0 volts.

23. A method as claimed in claim 20 wherein:

said preselected data contains information on at least one of alarm activation and faults and at least one parameter monitored in real time.

24. A method as claimed in claim 23 wherein the parameter comprises at least one of ambient temperature, battery voltage level and sensor readings.

25. A method as claimed in claim 20 wherein said microcontroller is configured to switch from a sleep mode to said operating mode after a first preselected count.

* * * * *

UNITED STATES PATENT AND TRADEMARK OFFICE

CERTIFICATE OF CORRECTION

PATENT NO. : 8,653,980 B2
APPLICATION NO. : 13/146340
DATED : February 18, 2014
INVENTOR(S) : Peter Brigham et al.

It is certified that error appears in the above-identified patent and that said Letters Patent is hereby corrected as shown below:

In the Claims:

claim 16, at column 8, line 10, delete the words "any of"

claim 19, at column 8, line 20, delete the words "An alarm" and add the words "A method"

Signed and Sealed this
Sixth Day of May, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,653,980 B2
APPLICATION NO. : 13/146340
DATED : February 18, 2014
INVENTOR(S) : Brigham et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 337 days.

Signed and Sealed this
Twenty-ninth Day of September, 2015

Michelle K. Lee

Michelle K. Lee
*Director of the United States Patent and Trademark Office*